US011891210B2

(12) United States Patent
Grabher et al.

(10) Patent No.: US 11,891,210 B2
(45) Date of Patent: Feb. 6, 2024

(54) BASKET ASSEMBLY WITH SOCKET RECESSES AND LOCKABLE CONNECTING POSTS FOR AN EXTENSION PART

(71) Applicant: FRIES Planungs—und Marketinggesellschaft m.b.H., Sulz (AT)

(72) Inventors: Markus Grabher, Lustenau (AT); Tobias Watzenegger, Weiler (AT)

(73) Assignee: FRIES Planungs—und Marketinggesellschaft m.b.H., Sulz (AT)

( * ) Notice: Subject to any disclaimer, the term of this patent is extended or adjusted under 35 U.S.C. 154(b) by 108 days.

(21) Appl. No.: 17/495,929

(22) Filed: Oct. 7, 2021

(65) Prior Publication Data

US 2022/0106076 A1 Apr. 7, 2022

(30) Foreign Application Priority Data

Oct. 7, 2020 (AT) ..... GM 102/2020

(51) Int. Cl.
*B65D 21/08* (2006.01)
*B65D 21/02* (2006.01)
*B65D 6/08* (2006.01)

(52) U.S. Cl.
CPC ..... *B65D 21/086* (2013.01); *B65D 11/14* (2013.01); *B65D 21/0215* (2013.01)

(58) Field of Classification Search
CPC .. B65D 21/086; B65D 11/14; B65D 21/0215; B65D 21/0212; B65D 21/0224; B65D 25/205; A47L 19/04; A47L 15/501
See application file for complete search history.

(56) References Cited

U.S. PATENT DOCUMENTS

| | | | |
|---|---|---|---|
| 3,482,707 | A | 12/1969 | Weiss |
| 4,353,470 | A | 10/1982 | Polhemus et al. |
| 5,054,629 | A | 10/1991 | Breen |
| 5,752,602 | A | 5/1998 | Ackermann et al. |
| 5,934,486 | A | 8/1999 | Jarvis et al. |
| 6,394,274 | B1 | 5/2002 | Cheeseman |
| 2007/0080089 | A1 | 4/2007 | Anschutz |
| 2008/0296194 | A1 | 12/2008 | Stahl |

(Continued)

FOREIGN PATENT DOCUMENTS

| | | |
|---|---|---|
| AT | 321809 | 4/1975 |
| AT | 8270 | 5/2006 |

(Continued)

*Primary Examiner* — Andrew D Perreault
(74) *Attorney, Agent, or Firm* — Volpe Koenig

(57) ABSTRACT

A basket assembly having a main basket (1) and an extension part (2) and connecting posts (3). The main basket (1) has a basket base (4) and side walls (5) and socket recesses (6, 7) for the connecting posts (3) are formed in each case in the side walls (5) and in the extension part (2). The extension part (2) is fastened or is fastenable on the main basket (1), at a distance from the main basket (1), by the connecting posts (3) locked releasably in the socket recesses (6, 7), and the connecting posts (3) are each releasably locked or lockable in one of the socket recesses (6) of the side walls (5) of the main basket (1) by a twist lock (8), and are each releasably locked or lockable in one of the socket recesses (7) of the extension part (2) by a twist lock (8).

11 Claims, 7 Drawing Sheets

(56) References Cited

U.S. PATENT DOCUMENTS

| | | | | |
|---|---|---|---|---|
| 2009/0050587 | A1 | 2/2009 | Sandor | |
| 2017/0027411 | A1 | 2/2017 | Gobl | |
| 2018/0290795 | A1 | 10/2018 | Green | |
| 2020/0087029 | A1 * | 3/2020 | Grabher | B65D 25/22 |

FOREIGN PATENT DOCUMENTS

| | | |
|---|---|---|
| CH | 701909 | 7/2013 |
| DE | 7720667 | 10/1977 |
| DE | 3702550 | 8/1988 |
| DE | 8914420 | 3/1990 |
| DE | 9105963 | 9/1991 |
| DE | 4124635 | 2/1992 |
| DE | 19754960 | 6/1999 |
| DE | 202005010154 | 10/2005 |
| DE | 202010006233 | 11/2010 |
| EP | 0380927 | 8/1990 |
| EP | 3124391 | 9/2018 |
| EP | 3434611 | 1/2019 |
| EP | 3587294 | 1/2020 |
| EP | 3981701 | 4/2022 |
| FR | 1437597 | 3/1966 |
| GB | 1354221 | 5/1974 |
| KR | 940026705 | 12/1994 |
| KR | 20080005332 | 11/2008 |
| WO | 2014063040 | 4/2014 |

* cited by examiner

BASKET ASSEMBLY WITH SOCKET RECESSES AND LOCKABLE CONNECTING POSTS FOR AN EXTENSION PART

INCORPORATION BY REFERENCE

The following documents are incorporated herein by reference as if fully set forth: Austrian Utility Model Application No. GM 102/2020, filed Oct. 7, 2020.

TECHNICAL FIELD

The present invention relates to a basket assembly having a main basket and an extension part and connecting posts, wherein the main basket has a basket base and side walls and socket recesses for the connecting posts are formed in each case in the side walls and in the extension part, wherein the extension part is fastened or is fastenable on the main basket, at a distance from the main basket, by the connecting posts locked releasably in the socket recesses.

BACKGROUND

Generic basket assemblies are known, for example, from AT 8270 U1. Here they are referred to as dishwasher baskets. They consist of a modularly constructed basket with the main basket and the extension part, wherein the extension part and the main basket are connected to each other via the connecting posts. By using connecting posts of different lengths, modularly constructed baskets or basket assemblies can thus be created in which the main basket and the extension part are fastened on each other, at a different distance from each other. It can be used as a type of modular construction system in which the total height of the modularly constructed basket or the basket assembly can be adapted to the objects to be stored inside the basket assembly or the modularly constructed basket.

In AT 8270 U1, the connecting posts are anchored in the socket recesses of the main basket and the extension part by snap connections. This has the disadvantage that such snap connections can often be released only with difficulty and the exchanging of the connecting posts or replacing of the connecting posts with longer or shorter connecting posts can be relatively complicated.

SUMMARY

The object of the invention is to propose an improvement in this regard.

Starting from the abovementioned generic basket assembly, the invention provides that the connecting posts are each releasably locked or lockable in one of the socket recesses of the side walls of the main basket by a twist lock, and are each releasably locked or lockable in one of the socket recesses of the extension part by a twist lock.

The invention thus provides to anchor or to lock the connecting posts in the socket recesses of the side walls of the main basket and the extension part twist locks and no longer, as in the abovementioned prior art, by snap connections. Such twist locks can be formed so that they can be released much more easily such that the connecting posts can be replaced much more easily than in the prior art mentioned. It is favorably provided here that the connecting posts are mounted or are mountable so that they can rotate back and forth between a locked position and an unlocked position respectively by the respective twist lock in the respective socket recess.

In this type of lock, it is thus provided that simple twisting of the respective connecting post is sufficient to move between the locked position and the unlocked position. In the locked position, the connecting posts are then fastened or fixed in the respective socket recess. In the unlocked position, they can be removed from the respective socket recess of the extension part or the main basket or the side walls of the latter.

It is in principle conceivable that the twist locks have respective stops in the locked position and also in the unlocked position, by virtue of which they cannot be twisted further. In such embodiments, to open or lock the twist lock, the connecting posts must necessarily be moved back and forth between the locked position and the unlocked position. However, basket assemblies according to the invention can be handled particularly easily if it is provided that each of the twist locks has a sequence of alternate successive locked positions and unlocked positions, wherein the respective connecting post can, by being twisted further in a single twisting direction, be brought successively into one of the locked positions and into one of the unlocked positions. In these preferred embodiments, it is irrelevant in which direction the connecting posts are twisted in order to pass from the locked to the unlocked position, or vice versa.

The extension part is preferably an extension frame. This is a simple frame which encloses an opening and has no base. For the sake of completeness, however, it should also be pointed out that basket assemblies according to the invention can be constructed from baskets or main baskets which are connected to one another by the connecting posts. In these cases, it can then be provided that the extension part is an extension basket with a basket base and side walls, wherein the socket recesses of the extension basket are arranged in its side walls.

In preferred embodiments of basket assemblies according to the invention, the twist locks are fastened, favorably countersunk, in the respective socket recess. In this sense, the socket recess could also be formed as an elongated socket channel both in the extension part and in the side walls of the main basket. By virtue of the arrangement of the twist lock being countersunk into the socket recess, the connecting posts must compulsorily be pushed some distance into the respective socket recess in order then to lock them, as a result of which support of the connecting posts on the wall regions, surrounding the respective socket recesses, of the side walls of the main basket or the extension part is obtained. This is favorable for the overall stability of the basket assembly according to the invention.

BRIEF DESCRIPTION OF THE DRAWINGS

Other features and details of preferred embodiments of the invention are explained below with the aid of an exemplary embodiment. It should hereby be pointed out that the individual features of this exemplary embodiment are not necessarily coupled with the other features of this exemplary embodiment and instead can also be combined in other combinations or individually with the basic concept of the invention.

In the drawings.

DETAILED DESCRIPTION

Figure 1:
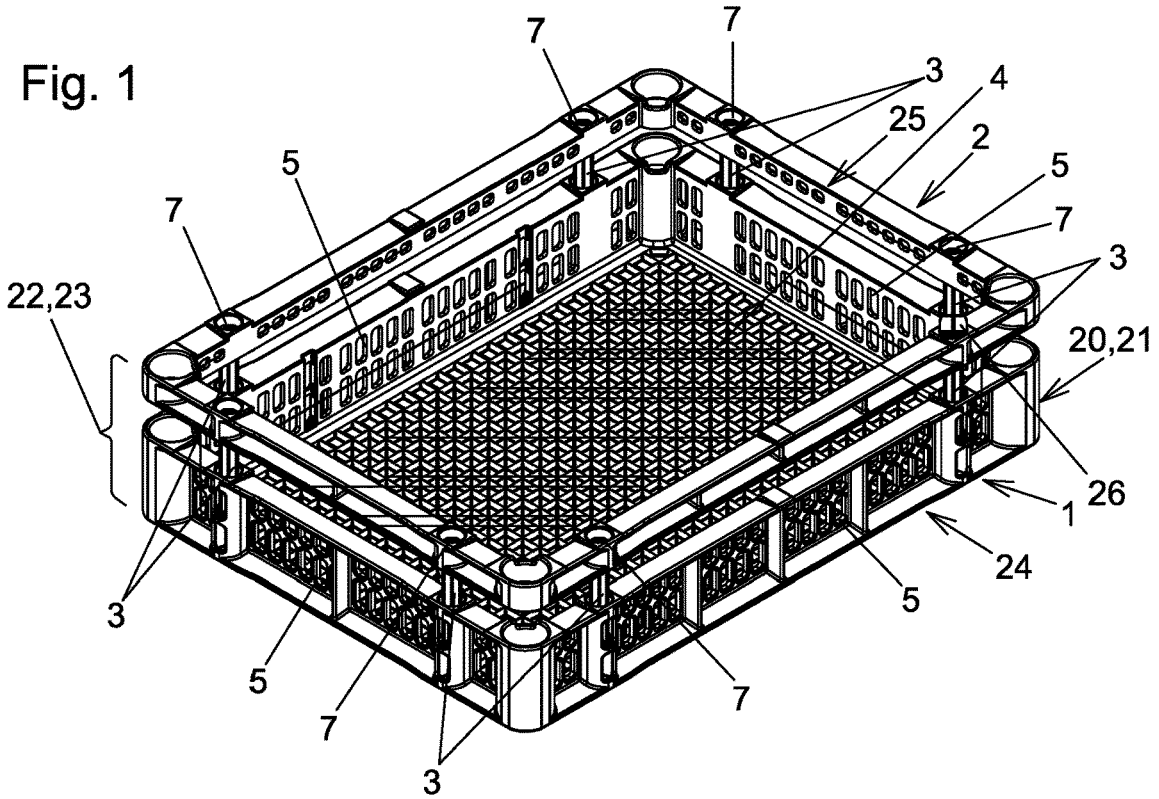
FIG. 1 shows a basket assembly according to the invention of this exemplary embodiment in a perspective view.

FIG. 1 shows a perspective view of an exemplary embodiment of a basket assembly according to the invention with a main basket 1 and an extension part 2 and connecting posts 3, wherein the main basket 1 has a basket base 4 and side walls 5 and socket recesses 6 and 7 for the connecting posts 3 are formed in each case in the side walls 5 and in the extension part 2, wherein the extension part 2 is fastened on the main basket 1, at a distance from the main basket 1, by the connecting posts 3 locked releasably in the socket recesses 6 and 7. According to the invention, the connecting posts 3 are in each case releasably locked by a twist lock 8 in one of the socket recesses 6 of the side walls 5 of the main basket 1 and are in each case releasably locked by a twist lock 8 in one of the socket recesses 7 of the extension part 2. It is favorably provided here, as already explained at the beginning, that the connecting posts 3 are mounted or are mountable so that they can rotate back and forth between a locked position and an unlocked position respectively by the respective twist lock 8 in the respective socket recess 6 or 7.

Basket assemblies according to the invention could also be referred to as modularly constructed baskets or simply modular baskets. The basket assemblies are created by corresponding assembly of the main basket 1 and the extension part 2 by the connecting posts 3, wherein the extension part 2 can be fastened on the main basket 1, at different heights or at different distances from the latter, by using connecting posts 3 of different lengths. In this way, basket assemblies according to the invention can be adapted easily to the size or height of the objects to be stored in the basket assembly. Basket assemblies according to the invention can be used, for example, as dishwasher baskets, for example for glasses or plates, but also as so-called industrial baskets for storing different technical objects therein or simply as a storage basket and/or transport basket. The term basket could also be replaced by crate, i.e. it is possible to refer to crate assemblies or modularly constructed crates or simply to modular crates.

If these basket assemblies are used not only for storage and/or transport but also for washing or rinsing and/or also for drying the objects stored therein, it is favorable if the basket base 4 of the main basket 1, as is known per se, has a lattice-like form or has at least some openings. The side walls 5 of the main basket can also have openings or alternatively have a lattice-like form.

The main basket 1, the extension part 2, and also the connecting posts 3, as well as the coding body 26, are favorably manufactured from plastic. They can, for example, be injection-molded parts. The whole basket assembly is favorably made from plastic.

For the purpose of as quick a connection as possible of the main basket 1 to the extension part 2, preferred embodiments of the invention provide that the respective connecting post 3 is releasably lockable by a single twisting movement by the respective twist lock 8 simultaneously both in one of the socket recesses 6 of the side walls 5 of the main basket 1 and in one of the socket recesses 7 of the extension part 2. In the case of connecting posts 3 which preferably have an elongated form, the twisting movement favorably takes place about a longitudinal axis of the respective connecting post 3.

Figure 2:
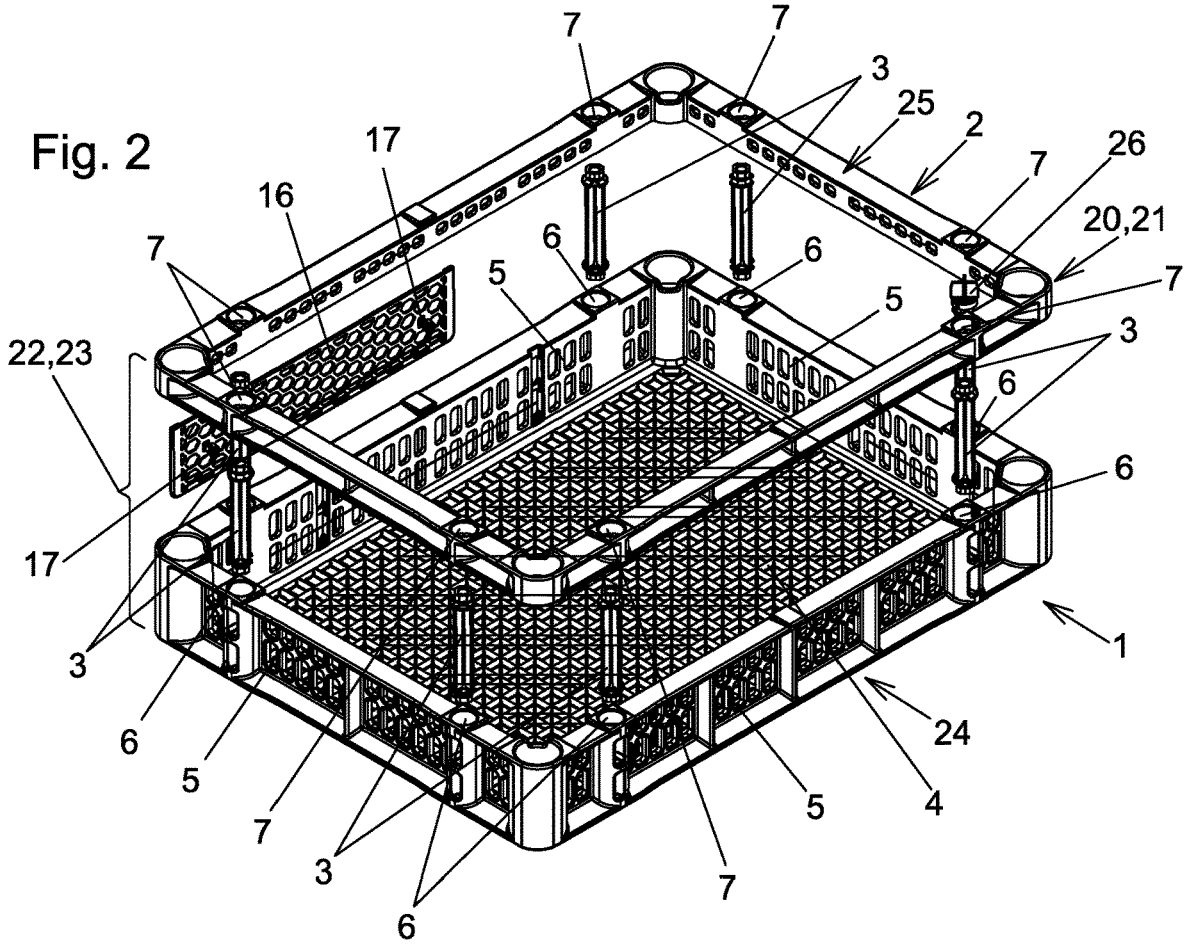
FIG. 2 shows an exploded view of FIG. 1.

The main basket 1, the extension part 2, and the connecting posts 3 are illustrated in an exploded view in FIG. 2. The connecting posts 3 are thus illustrated in FIG. 2 as unlocked and extracted from the respective socket recesses 6 and 7 of the side walls 5 of the main basket 1 and the extension part 2. In this state, the connecting posts 3 can be replaced by other connecting posts 3, in particular by longer or shorter connecting posts 3, in order thus to fasten the extension part 2 on the main basket 1 at a different height or at a different distance from the latter.

In this and in other preferred embodiments, the extension part 2 is formed as an extension frame. It encloses a central opening in the manner of a frame but does not have a base itself. As a variant of the exemplary embodiment shown here, a basket assembly according to the invention could, however, also have an extension basket with a basket base and with side walls as the extension part 2, wherein the socket recesses of the extension basket are arranged in the side walls of the latter. The extension basket could, for example, also have the same structure as the main basket 1. In such embodiments, which are not illustrated here, the basket assembly according to the invention would then have a plurality of baskets stacked on top of one another and fastened to one another, at a distance from one another, by the connecting posts 3.

The number of connecting posts 3 per basket assembly can of course vary. As implemented here, it is not absolutely necessary for two connecting posts 3 to be provided in each case per side wall 5 of the main basket 1. The positioning of the connecting posts 3 in the side walls 5 of the main basket 1 and in the extension part 2 can also differ from the exemplary embodiment shown here, for example it would also be conceivable to shift the connecting posts 3 into the corner regions of the side walls 5 of the main basket 1 and the extension part 2 but also further into central regions of the respective side wall 5.

The coding body 26 optionally provided here and its functioning will be described in detail separately below.

Figure 3:
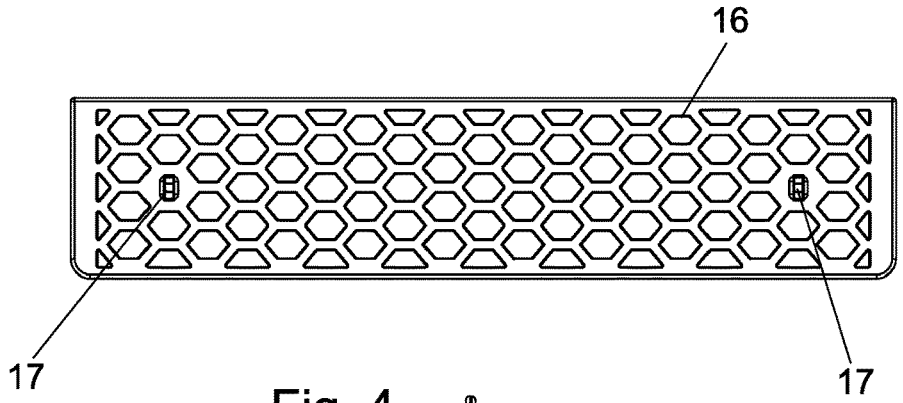
FIGS. 3 and 4 show detailed views of an optional label holder.
Figure 4:
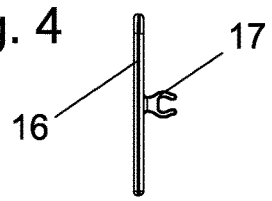

A label holder 16 illustrated in FIGS. 2, 3, and 4 can optionally be provided. As formed in the exemplary embodiment shown here, it can be attached to one of the side walls 5 of the main basket 1, for example by a clip 17.

Figure 5:
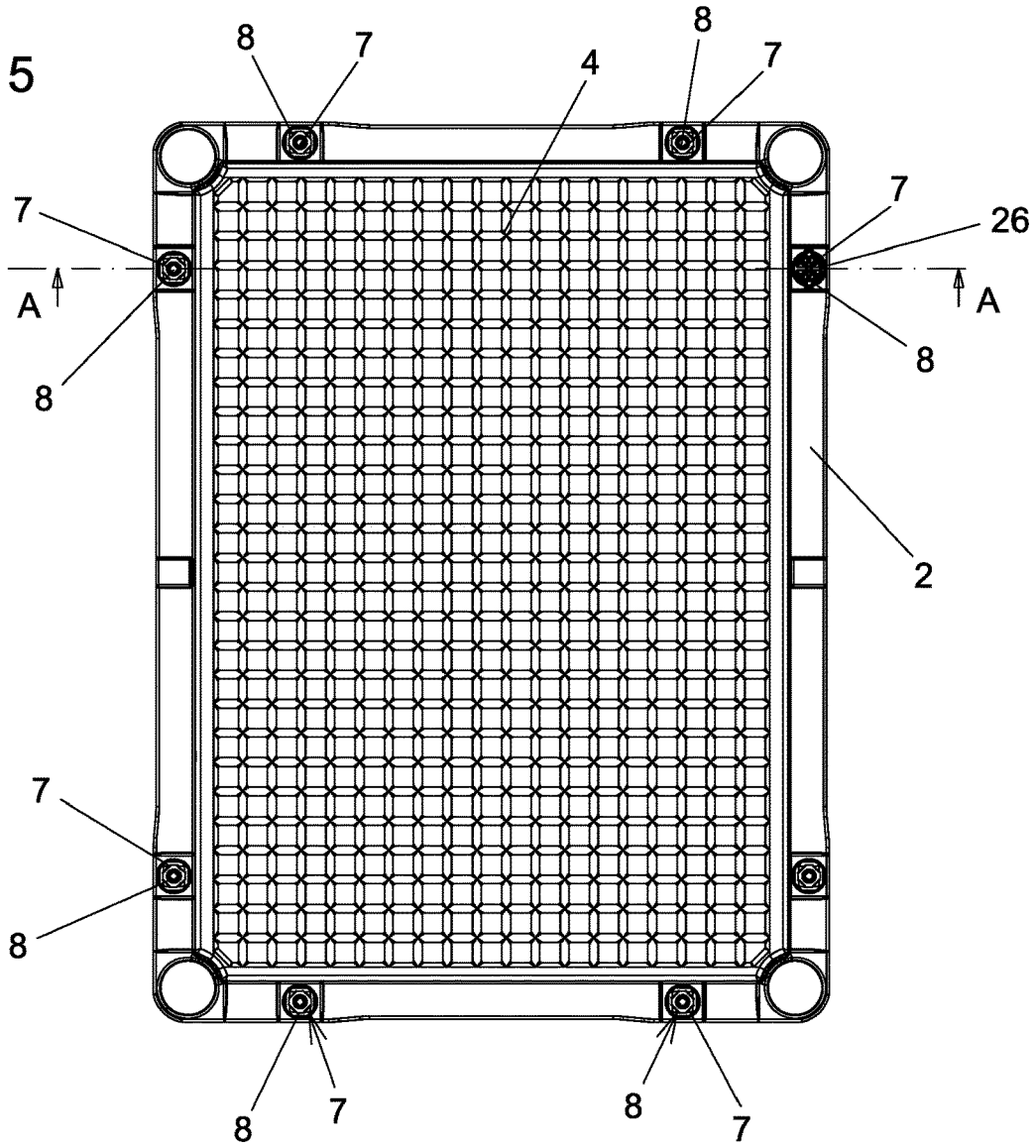
FIG. 5 shows a plan view of the basket assembly of this exemplary embodiment.
Figure 6:
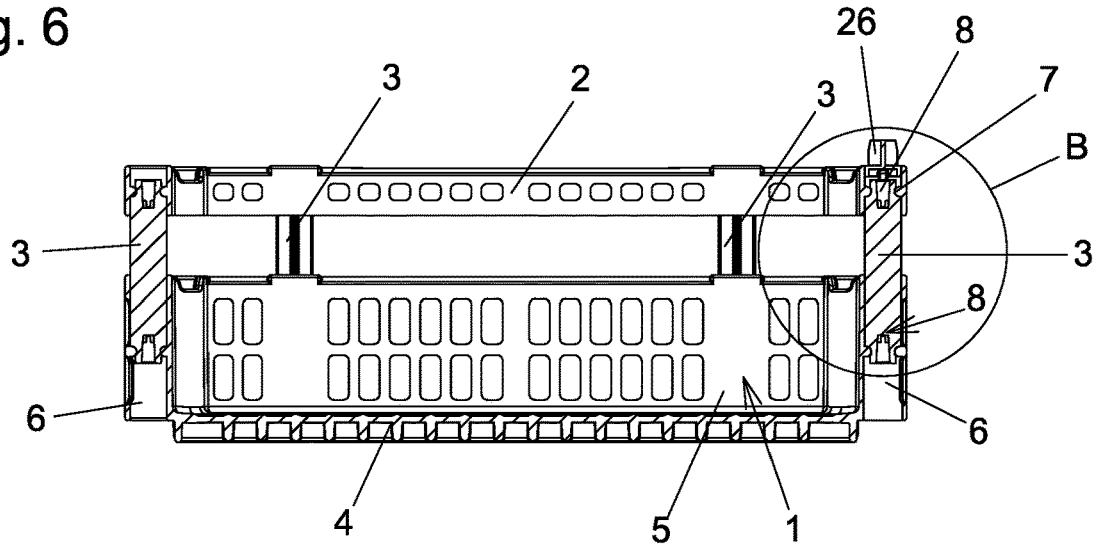
FIG. 6 shows the section along the line of section A-A from FIG. 5.
Figure 8:
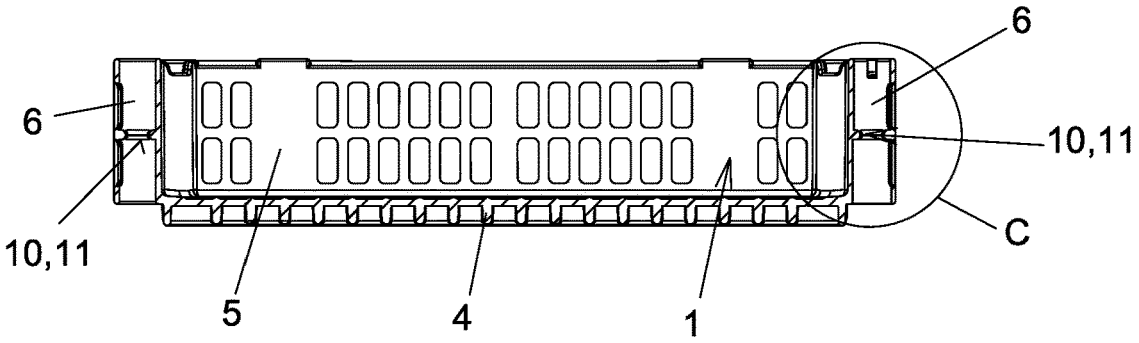
FIG. 8 shows a section similar to FIG. 6 but only through the main basket.
Figure 9:
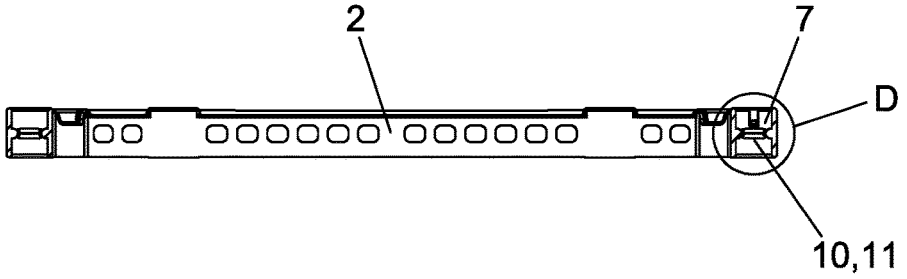
FIG. 9 shows a section similar to FIG. 6 but only through the extension part.
Figure 10:
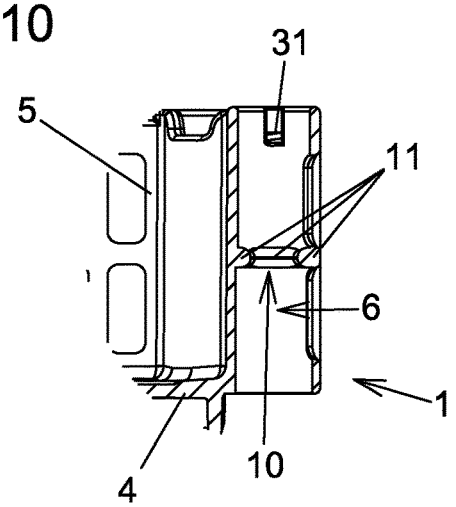
FIG. 10 shows the detail C from FIG. 8 at a larger scale.
Figure 11:
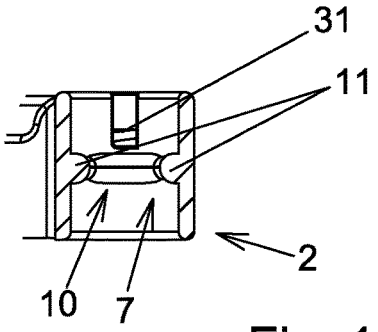
FIG. 11 shows the detail D from FIG. 9 at a larger scale.
Figure 12:
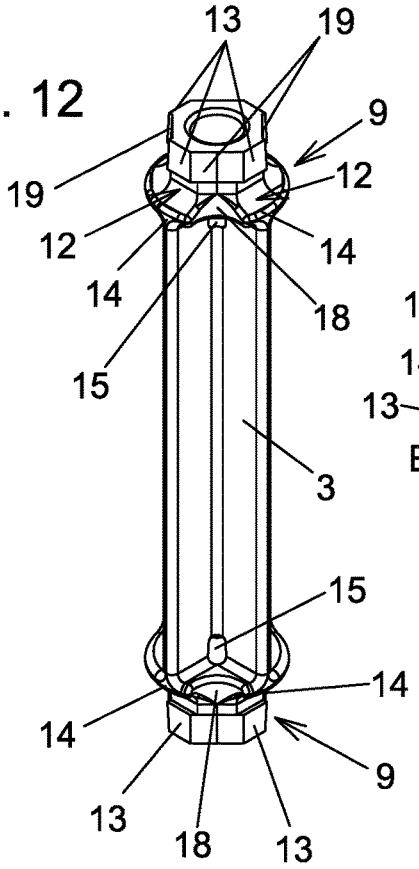
FIG. 12 shows a perspective view of a connecting post employed in this exemplary embodiment.
Figure 13:
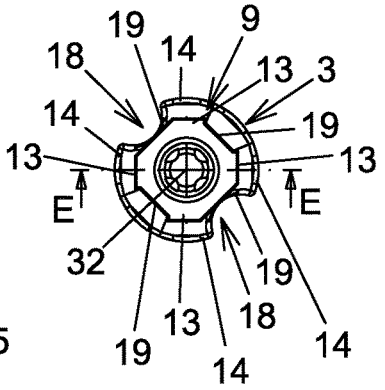
FIG. 13 shows a view from above of the connecting post according to FIG. 12.
Figure 14:
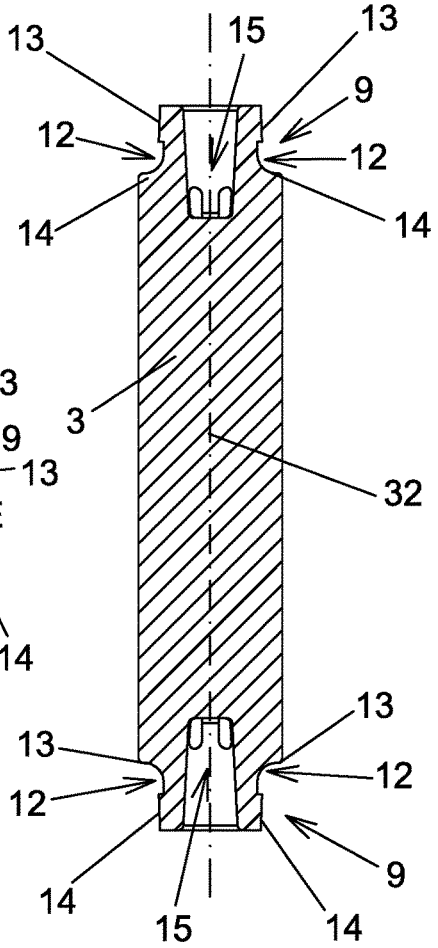
FIG. 14 shows the longitudinal section E-E according to FIG. 13 through the connecting post.
Figure 15:
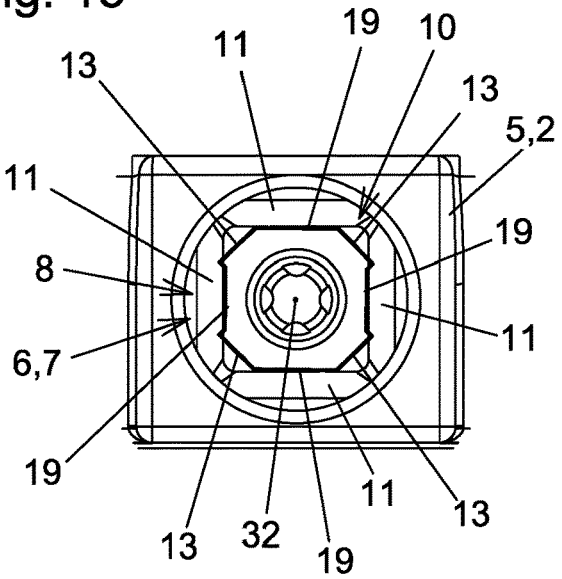
FIG. 15 shows a view of the unlocked position.
Figure 16:
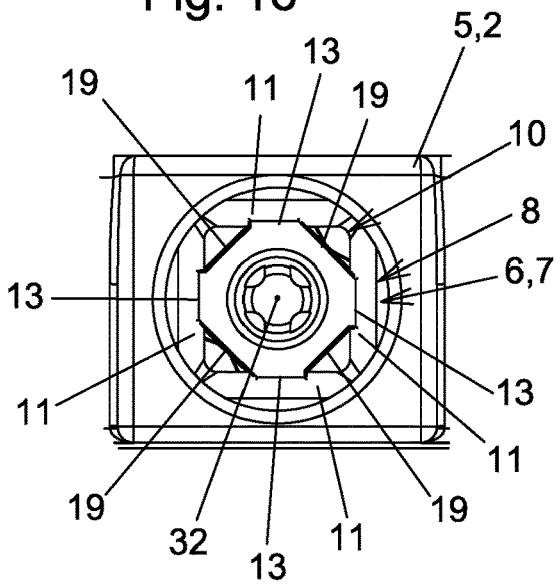
FIG. 16 shows a view of the locked position.

FIG. 5 shows a plan view of the basket assembly from FIG. 1. FIG. 6 shows the vertical section along the line of section A-A from FIG. 5, and FIG. 7 a detailed view of the region B from FIG. 6. FIG. 8 shows a section similar to FIG. 6, wherein, however, only the main basket 1 is illustrated. FIG. 9 shows just the extension part 2 in a similar section. FIG. 10 shows the region C from FIG. 8 at a larger scale. FIG. 11 shows the region D from FIG. 9 at a larger scale. The connecting posts 3 employed here in this exemplary embodiment of the invention are illustrated in FIGS. 12 to 14, wherein FIG. 14 shows the section along the line of section E-E. FIGS. 15 and 16 show the twist lock 8 in a view inside the socket recess 6 or 7, wherein FIG. 15 illustrates the unlocked position in which the connecting post 3 can be extracted from the socket recess 6 or 7. FIG. 16 shows the locked position in which the connecting posts 3 are locked in the respective socket recess 6 or 7 by the twist lock 8. As in the exemplary embodiment shown here, the twist locks 8 are favorably formed in the socket recesses 6 of the side walls 5 of the main basket 1 identically to the twist locks 8 in the socket recesses 7 of the extension part 2. In this exemplary embodiment, FIGS. 15 and 16 thus show the twist lock 8 both in the socket recess 6 of the side walls 5 and in the socket recesses 7 of the extension part 2.

It is favorably provided in the invention, as also implemented in the exemplary embodiment shown here, that the twist locks 8 are in each case formed from a twist lock part 9, formed on the connecting post 3, and a twist lock part 10 formed in the socket recess 6 or 7. It is also preferably provided in the invention that the twist lock part 9 formed on the connecting post 3 can be inserted in the or an unlocked position into the twist lock part 10 formed in the socket recess 6 or 7, and can be extracted therefrom and is locked in the or a locked position. This too is implemented in this way in the exemplary embodiment shown here.

Figure 7:
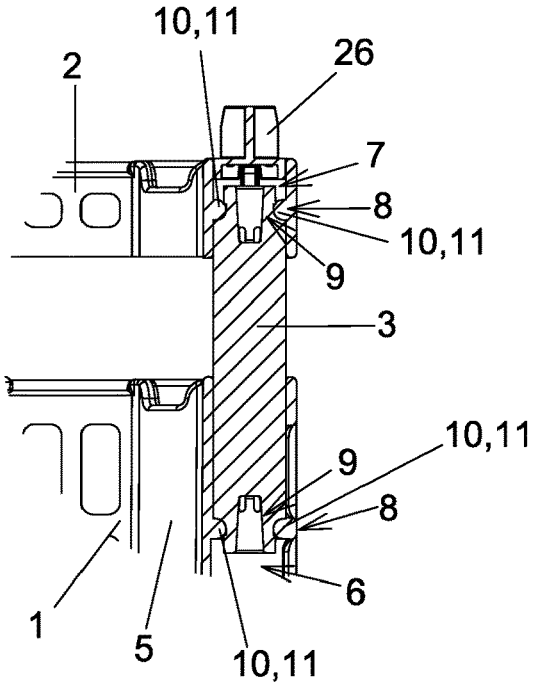
FIG. 7 shows the detail B from FIG. 6 at a larger scale.

If FIGS. 6 and 7 are now considered, it can be seen that the twist locks 8 are arranged somewhat countersunk both in the socket recesses 6 of the side walls 5 and in the socket recesses 7 of the extension part 2. This has the advantage that the connecting posts 3 are each supported by the wall sections adjacent to the twist lock 8 which surround the socket recesses 6 and 7. This countersunk arrangement of the twist lock 8 can of course also be formed in a different fashion as a variant of the exemplary embodiment shown concretely here.

The twist locks 8 formed identically in preferred exemplary embodiments such as this one in the two socket recesses 6 and 7 favorably make it possible, as also implemented here, for the respective connecting post 3 to be releasably lockable by a single twisting movement by the respective twist lock 8 at the same time both in one of the socket recesses 6 of the side walls 5 of the main basket 1 and in one of the socket recesses 7 of the extension part 2.

It has already been explained at the beginning that the twist locks 8 can be formed such that they have stops both in the locked position and in the unlocked position. In these embodiments, the connecting posts 3 can then only be twisted back and forth between the unlocked position and the locked position. However, preferred embodiments such as the one implemented here, provide that each of the twist locks 8 has a sequence of alternate successive locked positions and unlocked positions, wherein the respective connecting post 3 can be brought successively into one of the locked positions and into one of the unlocked positions by being twisted further in a single twisting direction. Generally speaking, the twist locks 8 could also be referred to as locking devices or as a locking apparatus. The connecting posts 3 could also be referred to as uprights, connectors, or spacers. They favorably have an elongated form. Their twist lock parts 9, which are provided to form the twist lock 8 according to the invention, are favorably situated at opposing ends of the connecting posts 3. The connecting posts 3 are favorably supplied with different lengths.

The twist lock devices 8 employed in the basket assemblies according to the invention can in principle have a very different design, for example they can be threaded or screw connections, a type of bayonet fitting, or the like. However, preferred embodiments of the invention provide that there is no lifting in the longitudinal direction of the connecting posts 3 when the connecting posts 3 are twisted between the locked position and the unlocked position, and the extension part 2 therefore always remains the same distance away from the main basket 1 during locking or unlocking. This is possible, for example, if, as provided in preferred alternative embodiments, the twist lock part 10 formed in the socket recess 6 or 7 has at least one bulge 11 and the twist lock part 9 formed on the connecting post 3 has at least one pair of clamping bodies 13, 14 delimiting a bulge socket recess 12, wherein the bulge 11 can preferably be firmly clamped elastically in the bulge socket recess 12 between the clamping bodies 13, 14 in the locked position. In preferred embodiments like those shown here, it is even provided that the twist lock part 10 formed in the socket recess 6 or 7 has a sequence of bulges 11 arranged in a plane and the twist lock part 9 formed on the connecting post 3 has at least one pair of clamping bodies 13, 14, preferably a number of pairs corresponding to the number of bulges 11, wherein the bulges 11, preferably all the bulges 11, can be firmly clamped in one of the bulge socket recesses 12 between the clamping bodies 13, 14 in the locked position. This also makes it possible to form a sequence of alternate successive locked positions and unlocked positions, wherein the respective connecting posts 3 can be brought successively into one of the locked positions and into one of the unlocked positions by continuing to be twisted in a single twisting direction. As a result, it is irrelevant which way the connecting post 3 is twisted in order to bring it from the locked position into the unlocked position, or vice versa. The bulges 11 arranged in a plane in this exemplary embodiment can be seen in FIGS. 6 to 11 and 15 and 16. By virtue of this arrangement of the bulges 11 in a plane, there is also no lifting generated in the longitudinal direction of the respective connecting post 3.

In the exemplary embodiment shown here, the bulges 11 are arranged in a square. However, this is only one exemplary embodiment. Other polygons with a different number of bulges 11 are, for example, also possible in order to obtain the sequence of bulges 11 arranged in a plane.

Reference is made to FIGS. 12 to 14, by way of example, with respect to the twist lock parts 9 of the connecting posts 3.

It can be clearly seen in particular in the longitudinal section according to FIG. 14 that each of the twist lock parts 9 has a number of bulge socket recesses 12, which are each delimited by a pair of two clamping bodies 13 and 14, which corresponds to the number of bulges 11 of the twist lock part 10. In each case one bulge 11 can be firmly clamped, preferably elastically, in the bulge socket recess 12 by the clamping bodies 13 and 14. Intermediate regions 19 with no bulge socket recess 12 are situated in each case between the clamping bodies 13 which are each formed in the end region of the respective connecting posts 3. These intermediate regions 19 are arranged closer to the axis of rotation 32 than the clamping bodies 13. The axis of rotation 32 is the axis about which the respective connecting post 3 can be twisted from the unlocked into the locked position, and vice versa.

The clamping bodies 14 which face the center of the respective connecting post 3, viewed in the longitudinal direction of the connecting post 3, are formed in this exemplary embodiment in the manner of a common plate-like structure, this not necessarily being the case. However, it is at any rate favorable in this case if this plate-like structure has at least one clearance 18. The function of the clearance 18 is explained in further detail below.

Before the connecting posts 3 can be twisted from the unlocked into the locked position, they first need to be pushed once into the respective socket recesses 6 or 7 to a point where their twist lock parts 9 can come into engagement with the twist lock parts 10 in the socket recesses 6 or 7 by subsequent twisting. This step of pushing the connecting posts 3 in, as well as extracting them, takes place in the position that can be seen in FIG. 15. In this position, it is possible to move past the intermediate regions 19 on the bulges 11 until the clamping bodies 13 are pushed so far between the bulges 11 that a twisting movement about the axis of rotation 32 is then possible. If, starting from FIG. 15, the connecting post 3 is twisted about the axis of rotation 32, the clamping bodies 13 and 14 come into engagement with the respective bulge 11, wherein the bulge 11 then comes to lie in the respective bulge socket recess 12 between the clamping bodies 13 and 14. By twisting by a corresponding amount, the locked position shown in FIG. 16 is then reached in which the bulges 11 are held firmly in the bulge socket recesses 12 between the clamping bodies 13 and 14 by being firmly clamped elastically. This position can also be clearly seen in FIGS. 6 and 7.

In a variant of the exemplary embodiment shown here, it would of course also be possible to form the twist lock parts 9 and 10 in the opposite fashion. In this case, the twist lock parts 9 of the connecting post 3 would have corresponding bulges 11 and the twist lock parts 10 of the socket recess 6 or 7 of the side walls 5 or of the extension part 2 would have corresponding bulge socket recesses 12 with corresponding clamping bodies 13 and 14.

In preferred embodiments of the invention, it can also be provided that, as also implemented here, water outlet openings 15 for draining water penetrating into the socket recess 6 or 7 in which the respective connecting post 3 is locked are formed in each case in the connecting posts 3. This serves to ensure that water which may enter the socket recesses 6 or 7, for example, during washing or rinsing procedures does not remain on the respective twist locks 8. For this purpose, in the exemplary embodiment shown, the water outlet openings 15 are provided in the connecting posts 3. Water penetrating from above into the socket recess 6 or 7 can flow out through them and through the clearance 18 and thus does not remain in the socket recesses 6 or 7 above the connecting posts 3 or their twist lock 8.

The coding body 26 which can be readily seen in FIGS. 1 and 2 and 6 and 7 is an optional feature of the invention. In preferred embodiments such as those shown here, it serves to ensure, together with the coding body socket 27, that in an assembly with at least two baskets 20 and 21 which can be stacked on top of each other, these baskets can be stacked on top of each other only in a single stacking position. In other words, the coding body 26, together with the coding body socket 27, prevents the possibility of two baskets 27 being stacked on top of each other in different stacking positions. A stacking position of two baskets is here a position in which the baskets are stacked on top of each other along their side walls, and, when viewed from above, the side walls are brought into a position where they are flush with and cover one another. A stacking position is therefore not one in which the baskets are not arranged on top of one another in any fashion, i.e. for example diagonally and transversely.

In preferred variants of the invention, there is an assembly with at least two baskets 20, 21 which can be stacked on top of each other, wherein each of the baskets 20, 21 has a basket base 4 and side walls 22, 23 and, in the case of baskets 20, 21 stacked on top of each other, the undersides 24 of the side walls 23 of the respective upper basket 21 lie on the upper sides 25 of the side walls 22 of the respective lower basket 20, wherein a coding body 26 protruding beyond this upper side 25 of this side wall 22 is arranged on the upper side 25 of at least one side wall 22 of the respective lower basket 20, and a coding body socket 27 is formed on the underside 24 of at least one side wall 23 of the respective upper basket 21, wherein the coding body 26 can be introduced into the coding body socket 27 exclusively in a single stacking direction sufficiently far for the purpose of stacking of the baskets 20, 21 on top of each other.

The arrangement of the baskets stacked one on top of the other in a stacking position is therefore only possible if the coding body 26 can be introduced sufficiently far into the coding body socket 27. This can be achieved by different measures. It can, for example, be provided that the coding body 26 is the sole coding body 26 of the lower basket 20 and the coding body socket 27 the sole coding body socket 27 of the upper basket 21. It is, however, equally possible that the coding body socket 27 is the sole opening in the underside 24 of the side walls 23 of the upper basket 21, into which the coding body 26 can be pushed sufficiently far or in which it fits completely. This can be obtained both by giving a corresponding shape to the coding body 26 and the coding body socket 27 and simply by the size of the opening cross-section of the coding body socket 27 in relation to the cross-sectional area 35 of the coding body 26. In such embodiments, it is then quite possible for multiple openings to be present in the underside 24 of the side walls 23 of the upper basket 21, wherein only one of these openings can be used for the coding body 26 by virtue of a corresponding size or cross-sectional area and/or shaping as a coding body socket 27.

The basket assembly according to the invention shown by way of example in FIG. 1, consisting of the main basket 1 and an extension part 2 fastened thereto by the connecting posts 3, can here form both a lower basket 20 and an upper basket 21. Accordingly, these reference numerals have already been marked in FIGS. 1 and 2. It can therefore be provided that the lower basket 20 has a main basket 1 and an extension part 2 and connecting posts 3, wherein the main basket 1 has the basket base 4 of the lower basket 20 and side walls 5 of the main basket 1 and socket recesses 6, 7 for the connecting posts 3 are formed respectively in the side walls 5 of the main basket 1 and in the extension part 2, wherein the extension part 2 is fastened on the main basket 1, at a distance from the main basket 1, by the connecting posts 3 arranged in the socket recesses 6, 7, and the side walls 22 of the lower basket 20 are formed by the side walls 5 of the main basket 1, the extension part 2, and the connecting posts 3, and the coding body 26 is arranged on an upper side 25, facing away from the main basket 1, of the extension part 2. Accordingly, the reference numerals 22 and 23 have also already been marked in FIG. 1 in order to illustrate that if the basket assembly from FIG. 1 is used as a lower basket 20 or as an upper basket 21, the side walls 22 of the lower basket 20 or the side walls 23 of the upper basket are in each case formed from the side walls 5 of the respective main basket 1 and the respective extension part 2 and the respective connecting posts 3. In this case, the coding body 26 of the lower basket 20 is then arranged on the upper side 25 of the side wall 22 of the lower basket 20 and hence on the upper side 25 of the extension part 2 of the lower basket 20. In contrast, the coding body socket 27 is then in these cases formed on the underside 24 of at least one side wall 5 of the main basket 1 of the upper basket 21.

In preferred embodiments such as those shown here, it is thus favorably provided that that the coding body 26 is fastened or fastenable in one of the socket recesses 7 for the connecting posts 3. It is furthermore favorable if, as also implemented here, one, preferably precisely one or in other words only one, of the socket recesses 6 for the connecting posts 3 forms the coding body socket 27.

It is in principle conceivable that the coding body 26 is fastened fixedly on the respective upper side 25 of the side walls 22 of the respective lower basket 20. Preferred embodiments such as those shown here provide, however, that the coding body 26 is fastenable on the upper side 25 of the side wall 22 of the respective lower basket 20 by a fastening device 28 which can be released non-destructively. The fastening device 28 is preferably formed for fastening the coding body 26, not using a tool, on the upper side 25 of the side wall 22 of the respective lower basket 20. It is preferably also provided that the fastening device 28 is formed for being released, not using a tool, from the upper side 25 of the side wall 22 of the respective lower basket 20. Even if there are other options for forming the fastening device 28, for example in the form of bayonet fittings, screw connections, and the like, preferred embodiments such as those shown here provide, however, that the coding body 26 is fastenable or fastened on the upper side 25 of the side wall 22 of the respective lower basket 20 by a snap connection 29.

Figure 17:
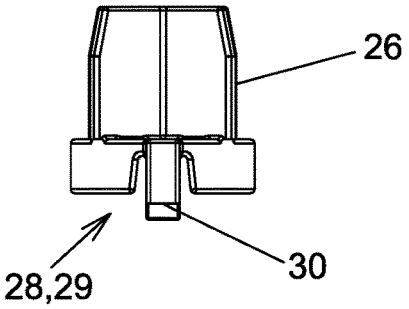
FIGS. 17 and 18 show views of the optional coding body employed in this exemplary embodiment.
Figure 18:
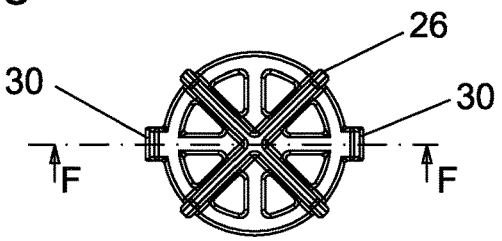
Figure 19:
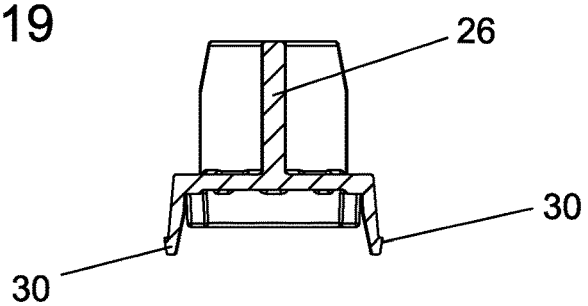
FIG. 19 shows the longitudinal section through the coding body along the line of section F-F from FIG. 18.

The coding body 26 implemented here in this exemplary embodiment is shown individually in FIGS. 17, 18, and 19. FIG. 17 shows a side view, FIG. 18 shows a plan view, and FIG. 19 shows the section along the line of section F-F from FIG. 18. In this exemplary embodiment, the coding body 26 is fastened on the upper side 25 of the side wall 22 of the respective lower basket 20 by a snap connection 29. The elastic hooks 30 formed for this purpose in this exemplary embodiment on the coding body 26 can be clearly seen in FIGS. 17, 18, and 19. In order to form the snap connection 29 and hence for the purpose of fastening on the upper side 25 of the respective lower basket 20, in the exemplary embodiment shown here these elastic hooks 30 are latched into corresponding undercuts 31 in the socket recesses 6 of the extension part 2. The undercuts 31 can be clearly seen in FIGS. 9 and 11.

These snap connections 29 are fastening devices 28 which enable the coding body 26 to be fastened and released, both without using a tool and non-destructively.

Figure 20:
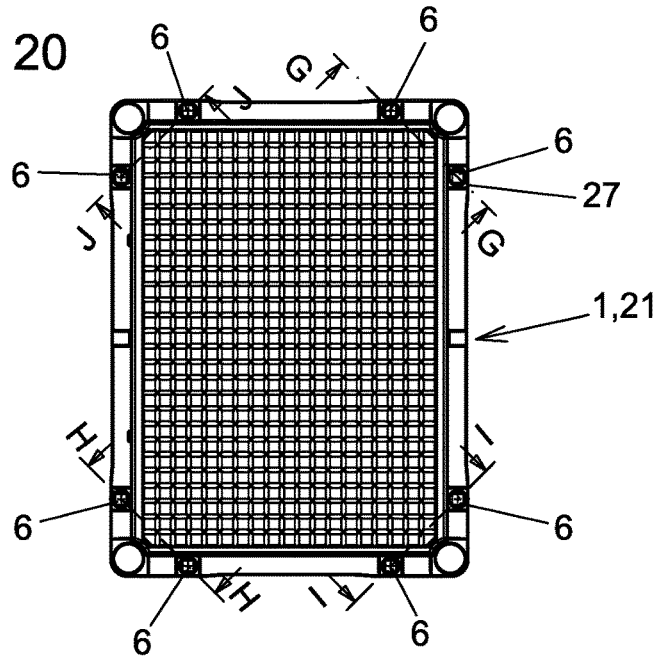
FIG. 20 shows a plan view of the main basket of this exemplary embodiment.
Figure 21:
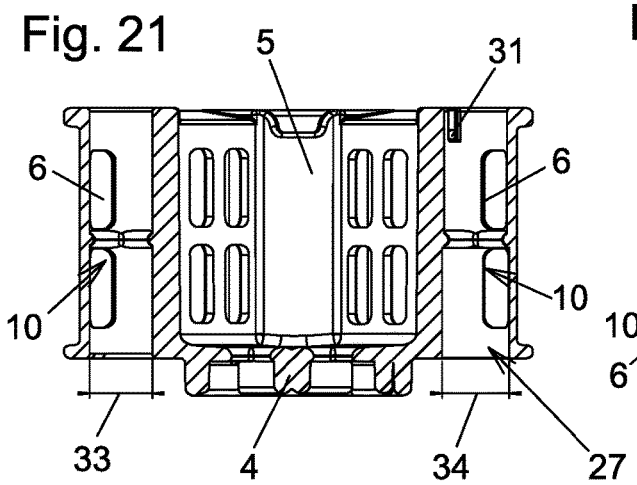
FIG. 21 shows the section along the line of section G-G from FIG. 20.
Figure 22:
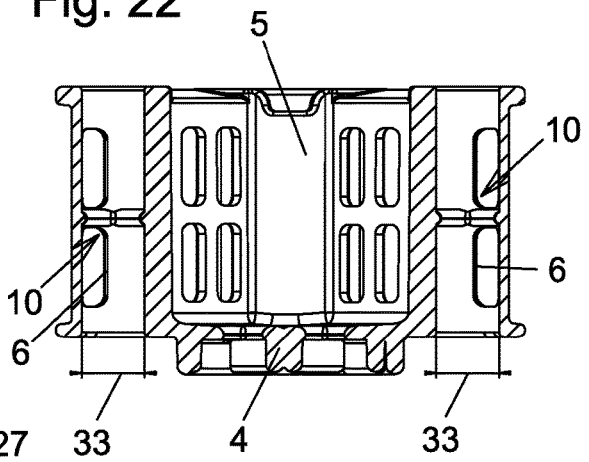
FIG. 22 shows the section along the line of section H-H from FIG. 20.
Figure 23:
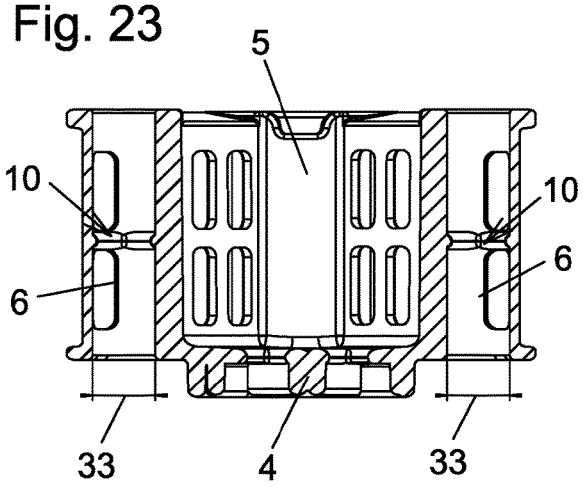
FIG. 23 shows the section along the line of section I-I from FIG. 20.
Figure 24:
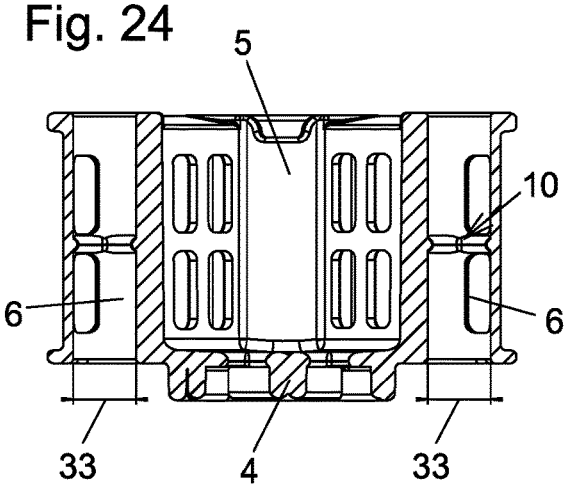
FIG. 24 shows the section along the line of section J-J from FIG. 20.

An example will now be explained with the aid of FIGS. 20 to 24 of how it can be ensured by use of the coding body 26 and the corresponding coding body socket 27 that the two or more baskets 20, 21 which can be stacked on top of one another can be stacked on top of one another only in a single stacking position. This is achieved in the example shown here by only a single coding body socket 27 being present per basket 20 or 21 into which the coding body 26 can be introduced sufficiently far. In the variants shown here, for this purpose precisely one of the socket recesses 6 is provided with an opening cross-section 34 of a size such that the coding body 26 can be introduced sufficiently far into it. FIG. 20 shows a plan view of a main basket 1 of the upper basket 21. It has a total of eight socket recesses 6, wherein FIG. 21 shows the section G-G, FIG. 22 the section H-H, FIG. 23 the section I-I, and FIG. 24 the section J-J. If FIGS. 21, 22, 23, and 24 are compared, it can be clearly seen that seven of the socket recesses 6 have a smaller opening cross-section 33 and only one of the socket recesses 6 has a larger opening cross-section 34, which qualifies this socket recess 6 as a single coding body socket 27.

Figure 25:
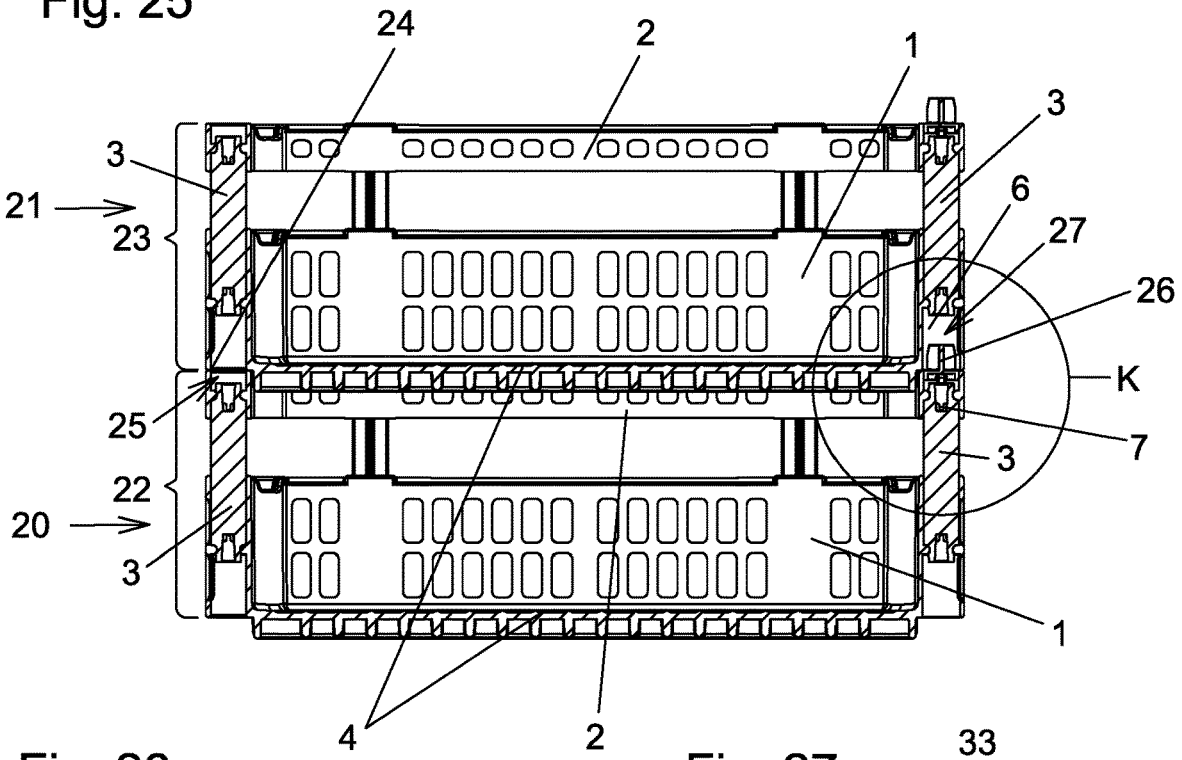
FIGS. 25 to 27 show views explaining the operating mode of the coding body.

FIG. 25 now shows a section through an assembly with the two baskets 20 and 21 stacked on top of one another, in the region of the coding body 26. Illustrated here is the sole possible stacking position in which the coding body 26 has penetrated sufficiently far into the coding body socket 27. It is also again illustrated in the section according to FIG. 25 that in this exemplary embodiment both the lower basket 20 and the upper basket 21 each consist of a main basket 1, the corresponding extension part 2, and the connecting posts 3. The side walls 22 and 23 of the lower basket 20 and the upper basket 21 are therefore formed from the corresponding side walls 5 of the respective main basket 1, the respective extension parts 2, and the respective connecting posts 3.

Figure 26:
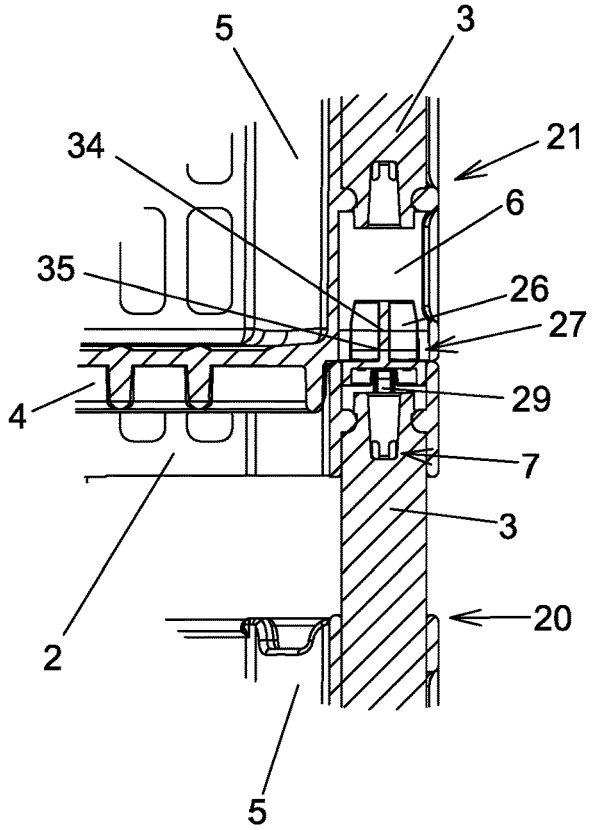

FIG. 26 shows the region K from FIG. 25 at a larger scale. In this FIG. 26 it can now clearly be seen that the opening cross-section 34 of the coding body socket 27 is large enough that the coding body 26 fits therein with its cross-sectional area 35.

Figure 27:
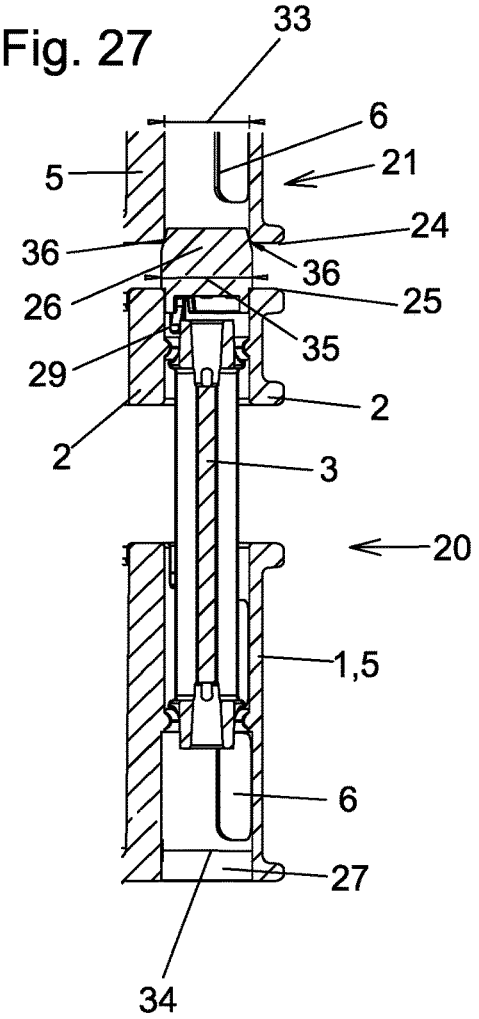

FIG. 27 now shows by way of example a detail corresponding to FIG. 26 which shows what happens if an attempt is made to stack the two baskets 20 and 21 on top of each other in a different stacking position. In this case, although the coding body 26 strikes a socket recess 6, the opening cross-section 33 of the latter is small enough that the coding body 26 does not fit into this small opening cross-section 33 with its cross-sectional area 33. This thus results in the collision designated by the reference numeral 36 such that these baskets 20 and 21 cannot be stacked on top of one another in this position which deviates from the sole possible stacking position.

It is a helpful situation for the people stacking the baskets 20 and 21 on top of one another if they can easily identify the status of the coding body 26. A technical means for doing this can be implemented by the coding body 26 being designed with a different color than the side wall 22 of the lower basket 20 on which it is arranged. In this way, the person stacking the baskets on top of one another can identify easily which way the baskets need to be stacked on top of one another.

KEY TO THE REFERENCE NUMERALS

1 main basket
2 extension part
3 connecting post
4 basket base
5 side wall
6 socket recess
7 socket recess
8 twist lock
9 twist lock part
10 twist lock part
11 bulge

12 bulge socket recess
13 clamping body
14 clamping body
15 water outlet opening
16 label holder
17 clip
18 clearance
19 intermediate region
20 lower basket
21 upper basket
22 side wall
23 side wall
24 underside
25 upper side
26 coding body
27 coding body socket
28 fastening device
29 snap connection
30 elastic hook
31 undercut
32 axis of rotation
33 small opening cross-section
34 large opening cross-section
35 cross-sectional area
36 collision

The invention claimed is:

1. A basket assembly, comprising:

a main basket having a basket base and side walls, and socket recesses formed in the side walls;

an extension part with socket recesses formed therein;

connecting posts engaged in the socket recesses of the main basket and the extension part;

wherein the extension part is fastened on the main basket, at a distance from the main basket, by the connecting posts that are locked releasably in the socket recesses of the side walls of the main basket and the extension part; and wherein the connecting posts are each releasably locked in one of the socket recesses of the side walls of the main basket by a first twist lock, and are each releasably locked in one of the socket recesses of the extension part by a second twist lock.

2. The basket assembly as claimed in claim 1, wherein the connecting posts are mounted for rotation back and forth between a locked position and an unlocked position respectively by the respective first and second twist locks in the respective socket recess of the side walls of the main basket and the extension part.

3. The basket assembly as claimed in claim 1, wherein each said connecting post is releasably lockable by a single twisting movement by the respective first and second twist locks simultaneously both in one of the socket recesses of the side walls of the main basket and in one of the socket recesses of the extension part.

4. The basket assembly as claimed in claim 1, wherein each of the first and second twist locks has a sequence of alternate successive locked positions and unlocked positions, and the respective connecting post is, by being twisted further in a single twisting direction, brought successively into one of the locked positions and into one of the unlocked positions.

5. The basket assembly as claimed in claim 1, wherein the extension part forms an extension frame.

6. The basket assembly as claimed in claim 1, wherein the first and second twist locks are each respectively formed from a twist lock part, formed on the connecting post, and a twist lock part formed in the socket recess of each of the side walls of the main basket and the extension part.

7. The basket assembly as claimed in claim 6, wherein the twist lock part formed on the connecting post is insertable in an unlocked position into the twist lock part formed in at least one of the socket recess of the side walls of the main basket or the extension part, and is extractable therefrom in the unlocked position, and is locked in a locked position.

8. The basket assembly as claimed claim 7, wherein the twist lock part formed in the socket recess of at least one of the side walls of the main basket or the extension part has at least one bulge and the twist lock part formed on the connecting post has at least one pair of clamping bodies delimiting a bulge socket recess, and the bulge is firmly clamp able in the bulge socket recess between the clamping bodies in the locked position.

9. The basket assembly as claimed in claim 7, wherein the twist lock part formed in the socket recess of at least one of the side walls of the main basket or the extension part has a sequence of bulges arranged in a plane and the twist lock part formed on the connecting post has at least one pair of clamping bodies, and the bulges, are firmly clampable in one of the bulge socket recesses between the clamping bodies in the locked position.

10. The basket assembly as claimed in claim 9, wherein the connecting post has a number of pairs of the clamping bodies corresponding to a number of the bulges.

11. The basket assembly as claimed in claim 1, wherein water outlet openings for draining water penetrating into the socket recess of at least one of the side walls of the main basket or the extension part in which the respective connecting post is locked are formed in the connecting posts.

* * * * *